US008390211B2

(12) United States Patent
Green et al.

(10) Patent No.: US 8,390,211 B2
(45) Date of Patent: Mar. 5, 2013

(54) CONSTANT LUMEN OUTPUT CONTROL SYSTEM

(75) Inventors: John D. Green, Milton, VT (US); Jack L. Ries, Licking, OH (US)

(73) Assignee: ABL IP Holding LLC, Conyers, GA (US)

( * ) Notice: Subject to any disclaimer, the term of this patent is extended or adjusted under 35 U.S.C. 154(b) by 999 days.

(21) Appl. No.: 12/083,742

(22) PCT Filed: Oct. 17, 2005

(86) PCT No.: PCT/US2005/037466

§ 371 (c)(1),
(2), (4) Date: Apr. 10, 2009

(87) PCT Pub. No.: WO2007/046795

PCT Pub. Date: Apr. 26, 2007

(65) Prior Publication Data

US 2009/0206775 A1 Aug. 20, 2009

(51) Int. Cl.
*H05B 37/02* (2006.01)

(52) U.S. Cl. ..... 315/291; 315/308

(58) Field of Classification Search ..... 315/291, 315/307, 308, 312–315
See application file for complete search history.

(56) References Cited

U.S. PATENT DOCUMENTS 4,182,977 A 1/1980 Stricklin, Jr.
4,533,853 A 8/1985 Hammond et al.
4,682,084 A 7/1987 Kuhnel et al.
4,686,428 A 8/1987 Kuhnel et al.
4,734,650 A 3/1988 Alley et al.
5,055,746 A 10/1991 Hu et al.
5,068,576 A 11/1991 Hu et al.
5,107,184 A 4/1992 Hu et al.
5,225,742 A 7/1993 Beasley
5,248,919 A 9/1993 Hanna et al.
5,373,217 A 12/1994 Gregor
5,399,940 A 3/1995 Hanna et al.
5,471,119 A 11/1995 Ranganath et al.
5,504,398 A 4/1996 Rothenbuhler
5,623,187 A 4/1997 Caldeira et al.
5,637,964 A 6/1997 Hakkarainen et al.
5,652,504 A 7/1997 Bangerter
5,677,602 A 10/1997 Paul et al.
5,691,605 A 11/1997 Xia et al.
5,757,145 A 5/1998 Johnson et al.
5,828,178 A 10/1998 York et al.
5,859,505 A 1/1999 Bergman et al.
5,874,809 A 2/1999 Hagen
5,925,990 A 7/1999 Crouse et al.
6,011,363 A 1/2000 Allison
6,034,488 A 3/2000 Lindauer et al.
6,057,674 A 5/2000 Bangerter
6,069,457 A 5/2000 Bogdan
6,075,326 A 6/2000 Nostwick (Continued)

*Primary Examiner* — Jimmy Vu
(74) *Attorney, Agent, or Firm* — Kilpatrick Townsend & Stockton LLP

(57) ABSTRACT

A constant lumen output control system for providing a constant lumen output throughout the life of a lamp at the mean or preset lumen level. The lumen con system (315) coupled to a lamp driver (310) initially reduces the power to the lamp (330) to prevent the lamp from being operated at power levels that result excess mean or preset lumen levels. With increased lamp usage, the lumen control system gradually increases power to the lamp to compensate for lamp lumen depreciation due to light-reducing mechanisms. By compensating for lamp lumen depreciation the lamp is operated at a constant mean or preset lumen output throughout the life of the lamp.

12 Claims, 9 Drawing Sheets

U.S. PATENT DOCUMENTS 6,107,754 A 8/2000 Kim
6,121,734 A 9/2000 Szabados
6,181,072 B1 1/2001 Leslie et al.
6,191,563 B1 2/2001 Bangerter
6,232,727 B1 5/2001 Chee et al.
6,259,215 B1 7/2001 Roman
6,545,433 B2 * 4/2003 Beij et al. ..... 315/291
6,583,573 B2 6/2003 Bierman
6,614,013 B2 9/2003 Pitigoi-Aron et al.
6,762,569 B1 7/2004 Holmes et al.
6,779,896 B2 8/2004 Luerkens et al.
6,784,622 B2 8/2004 Newman, Jr. et al.
6,819,060 B2 11/2004 Readio et al.
7,176,635 B2 * 2/2007 Gordin et al. ..... 315/226
2002/0079844 A1 6/2002 Gurin et al.
2003/0020412 A1 1/2003 Luerkens et al.
2003/0057888 A1 3/2003 Archenhold et al.
2003/0090210 A1 5/2003 Bierman
2003/0090215 A1 5/2003 Beasley
2003/0102816 A1 6/2003 Buij et al.
2003/0107332 A1 6/2003 Newman, Jr. et al.
2003/0155873 A1 8/2003 O'Meara
2003/0197113 A1 10/2003 Pitigoi-Aron et al.
2004/0017158 A1 1/2004 Ang et al.
2004/0113567 A1 6/2004 Yamauchi et al.
2007/0085487 A1 * 4/2007 Kuennen et al. ..... 315/209 R

* cited by examiner

CONSTANT LUMEN OUTPUT CONTROL SYSTEM

BACKGROUND

1. Field of the Invention

The present invention relates to lumen output control of a light source. More particularly, the invention provides a method and system for increasing and decreasing a ballast output power, which is connected a light source, to provide a constant light output during the life of the light source.

2. Description of the Related Art

Over time, the lumen output of a lamp continually decreases Lumen output can be defined as a unit of luminous flux equal to the light emitted in a unit solid angle by a uniform point source of one candle intensity. As related to power, a lumen is $1/683$ watts of radiant power at a frequency of $540\times10^{12}$ Hertz. The lumen output degradation in the lamp can occur for a variety of reasons, for example, lamp lumen depreciation, the lamp's interaction with a ballast, supply voltage variations, dirt or dust on the lamp, and the ambient temperature in a fixture. FIG. 1 illustrates a lumen degradation curve for a typical quartz metal halide high intensity discharge (HID) lamp that uses a conventional ballast. FIG. 1 is a chart 100 illustrating two curves in relation to an X-axis 102 (lamp operating hours) and a Y-axis 104 (lumens per lamp watt). The curve 106 illustrates the degradation curve for a magnetic constant wattage autotransformer (CWA) lamp and the curve 108 illustrates a degradation curve for a Prismatron™ lamp. As lamp operating hours increase for the lamp, the lumen output of the lamp decreases.

The decrease in lumen output occurs due to a variety of processes that occur within the lamp. One factor contributing to this decrease is a loss of chemicals that contributing to light output. These chemicals can be lost through portions of the lamp structure, for example, an arc container Another factor contributing to light degradation is metal being deposited on an arc tube wall of the lamp. An HID lamp is started by applying a very high voltage across an arc tube to break down high pressure gasses within the lamp into a conduction state. Following this breakdown, high current normally flows across a relatively low-voltage arc that heats the electrodes, which subsequently enter into thermionic emission. This tends to eject molecules of the metal electrode material that eventually condense on the wall of the arc tube, causing "blackening" and lowering the light transmission of the arc tube.

Due to such degradation in lumen output, many lighting applications are designed using a mean light level. The mean light level, or lamp's lumen, is defined when a HID lamp is at forty percent of its rated life. Typically to achieve a minimum light level emission, a lighting system designer will design a lighting system at the mean light level. Once the lamp is at a point past the mean light level, replacement of the lamp is usually necessary to maintain a desired light output level.

In HID applications, a ballast is used to control the operating power delivered to a lamp. FIG. 2 is a block diagram 200 illustrating a typical ballast 202. The ballast 202 regulates the power to the lamp 204 which is received as an input voltage from a power source (not shown). The ballast 202 also provides proper starting conditions for the lamp 204 at start-up Some ballast designs use magnetic transformers. As a result, the output level of a lamp cannot be varied and is limited to an output of full power or some fixed output level lower than full power. Other ballast designs, such as electronic ballasts, provide for continuous variation of lamp voltage between full power and a predetermined lower limit.

However, a problem with conventional ballast systems, using the mean light level to set a desired lamp output, is that the ballast initially consumes additional power for the time period prior to achieving the mean light level. Powering the lamp at full output prior to achieving the mean light level causes an output higher than is necessary which consumes more power than necessary to provide the desired light output.

Accordingly, there is a need and desire for a ballast having a power regulation technique for outputting power to a lamp, which will create a constant lumen output from the lamp, thereby decreasing the power consumption of the lamp system.

SUMMARY

The present invention provides a constant output lumen control system that has the ability to provide a continuous lumen output from a lamp over the lifetime of the lamp. The lighting system initially reduces the power to the lamp, and subsequently varies the power delivered to the lamp to compensate for light-reducing mechanisms that will affect the lumen output of the lamp over time. By properly adjusting the power delivered to the lamp, the lighting system provides a constant light output from the lamp.

BRIEF DESCRIPTION OF THE DRAWINGS

The foregoing and other advantages and features of the invention will become more apparent from the detailed description of exemplary embodiments of the invention given below with reference to the accompanying drawings.

DETAILED DESCRIPTION

In the following detailed description, reference is made to the accompanying drawings, which form a part hereof, and which is shown by way of illustration of specific embodiments in which the invention may be practiced. These embodiments are described in sufficient detail to enable those skilled in the art to practice the invention, and it is to be understood that other embodiments may be utilized, and that structural, logical, and programming changes may be made without departing from scope of the present invention.

Figure 1:
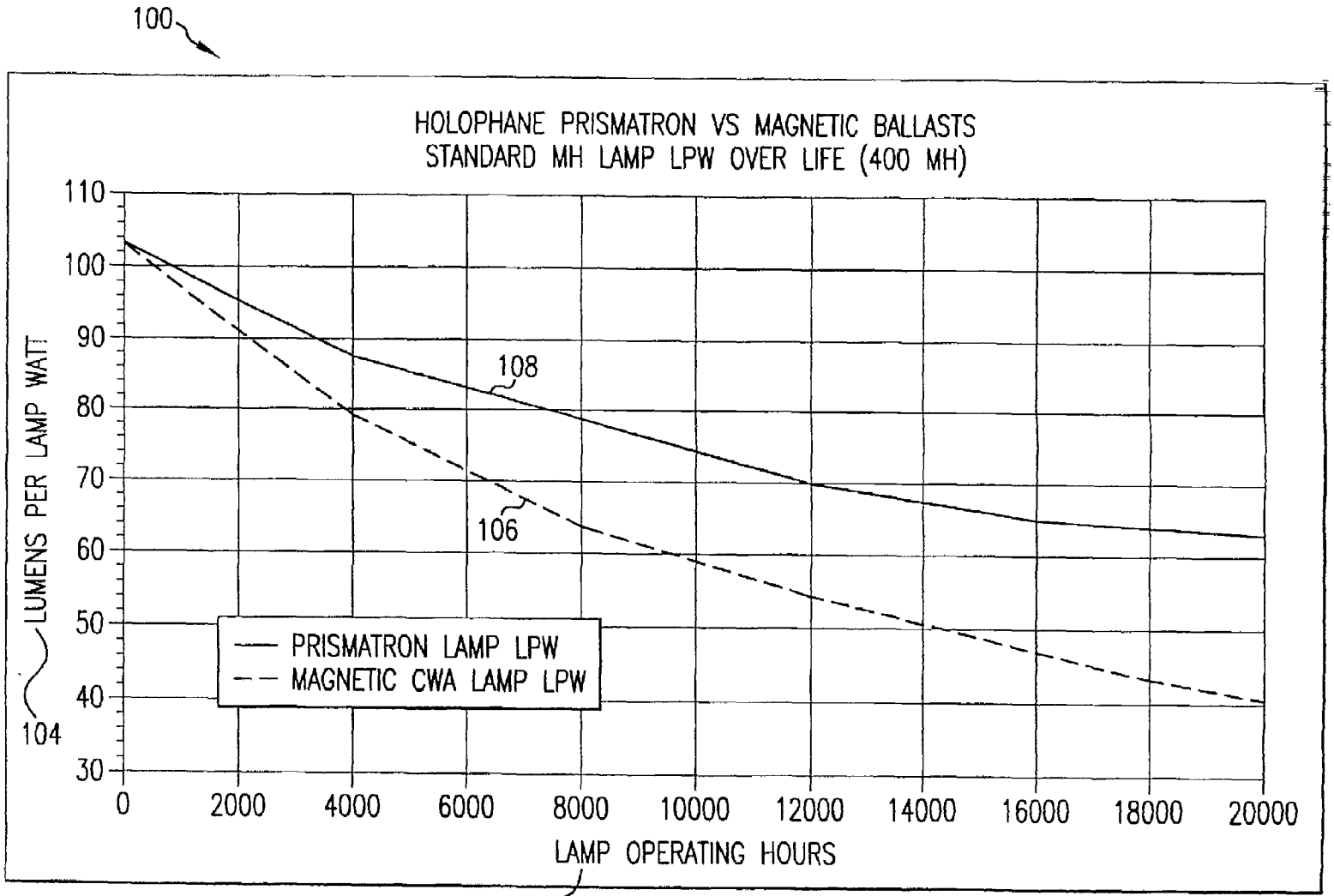
FIG. 1 is a chart illustrating a lumen degradation curve for a typical standard metal halide HID lamp.
Figure 2:
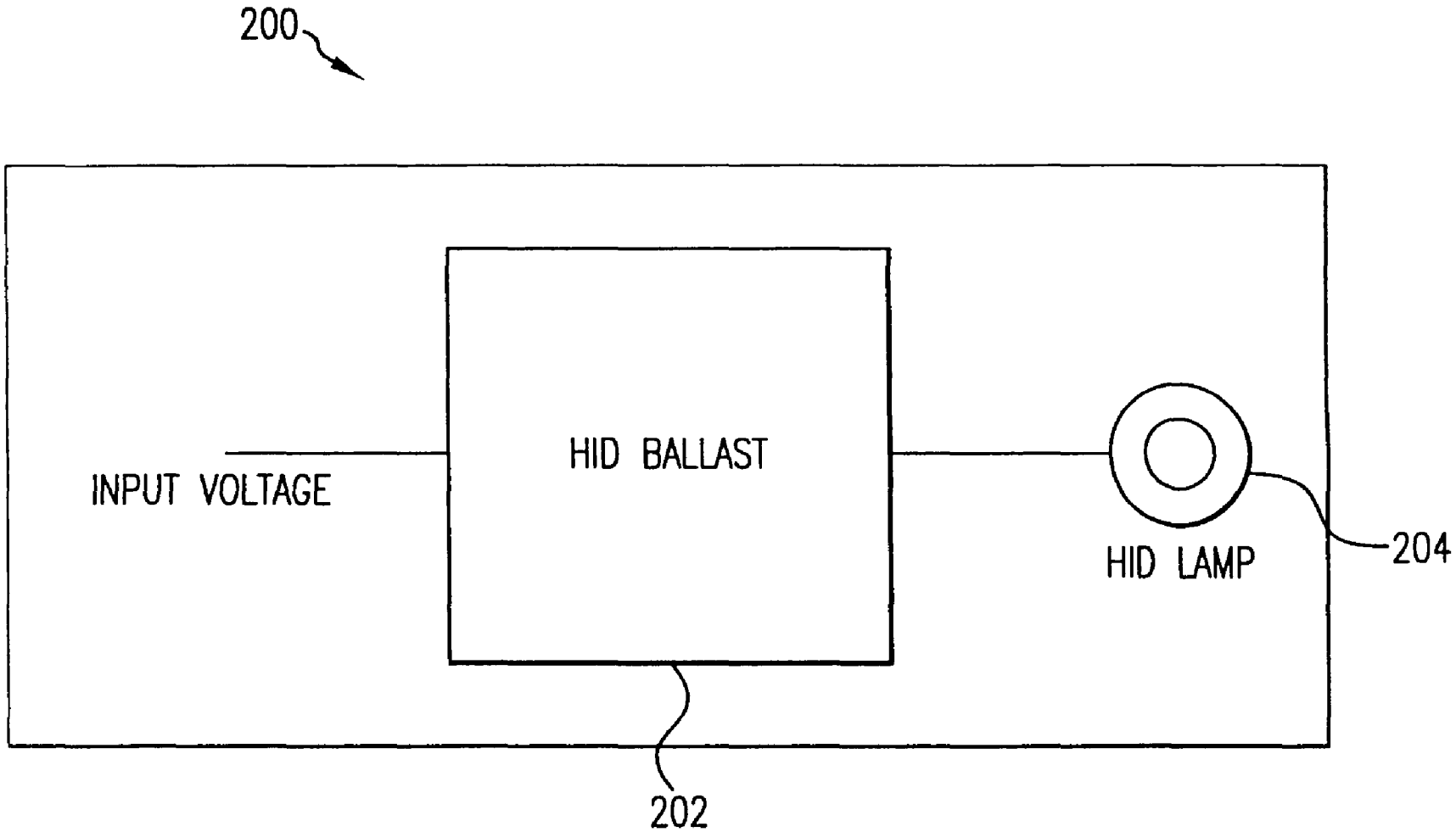
FIG. 2 is a block diagram illustrating a typical ballast design.
Figure 3:
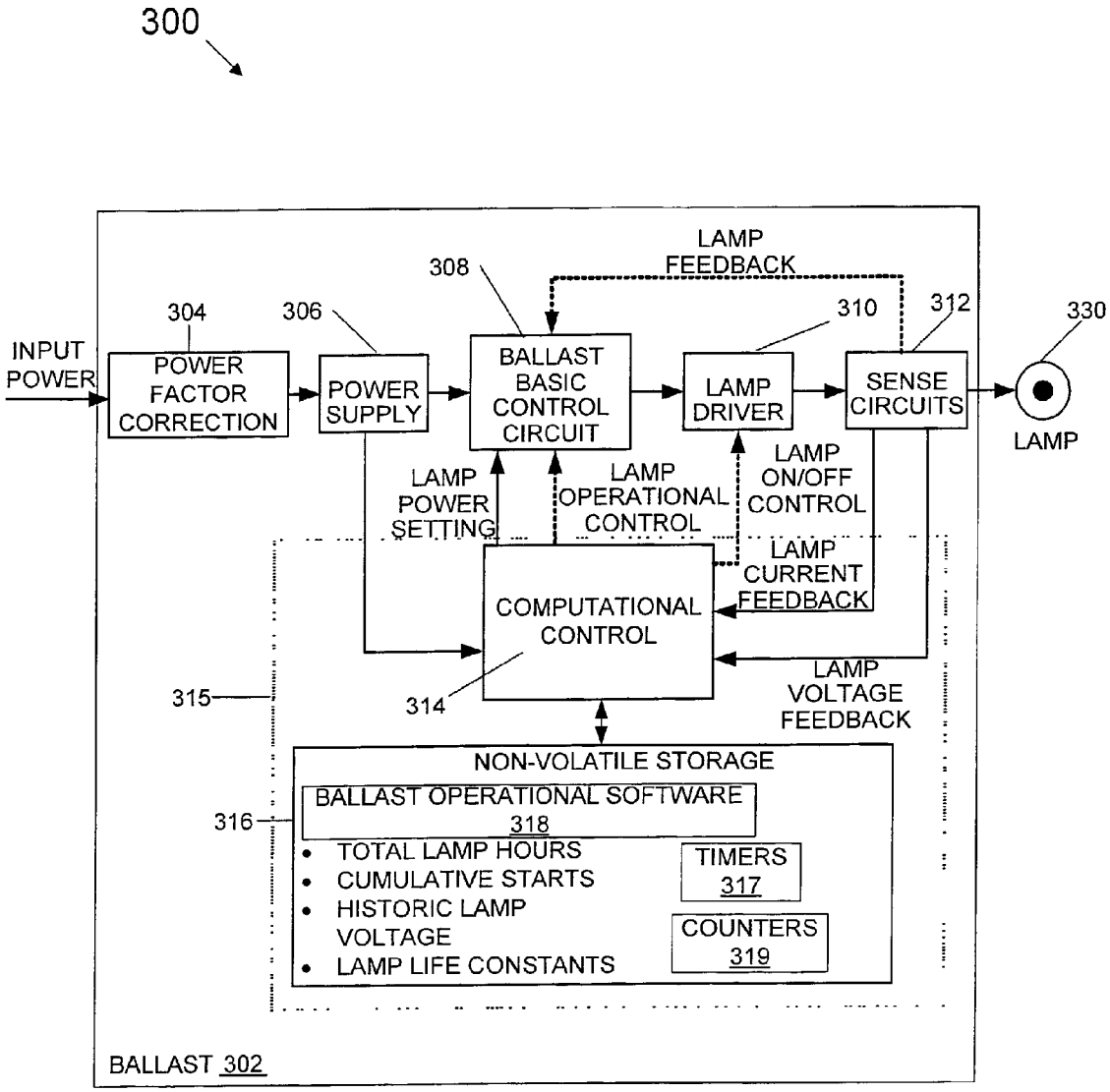
FIG. 3 is a block diagram illustrating a ballast design including lumen control circuitry in accordance with an embodiment of the invention.

FIG. 3 is an exemplary illumination control system 300 employed in a ballast 302. The ballast 302 includes a power factor correction circuit 304, a power supply 306, a ballast control circuit 308, a lamp driver 310, sense circuits 312, and an illumination control system 315. The illumination control system 315 includes a computational control circuit 314 and a non-volatile storage device 316. Non-volatile storage device 316 may use any comparable non-volatile memory format, for example, dynamic random access memory (DRAM), flash memory, magneto-resistive random access memory (MRAM), etc. Computational control circuit 314 may utilize a microprocessor or any other comparable processing device to conduct mathematical processing for adjusting power supplied to the lamp 330 to achieve a constant lumen output from the lamp 330. Non-volatile storage device 316 provides storage for various computational equations, mathematical constants, ballast operational software 318, timers 317, counters 319 and information regarding various lamp types, and their specific operational requirements which are used by the computational control circuit 314 during processing. The lamp 330 can be any type of high intensity discharge lamp (HID), such as HID lamps that use high pressure mercury, high pressure sodium, or some other suitable gas.

The ballast control circuit 308 adjusts the power received from the power supply 306 for use by the lamp 330. The ballast control circuit 308 receives a lamp power setting signal and a lamp operational control signal from the computational control circuit 314. The ballast control circuit 308 also receives a lamp feedback signal from the sense circuits 312 and provides operating power to the lamp driver 310. The lamp driver 310 starts the lamp 330, receives operating power from ballast control circuit 308, and provides operating power to the sense circuits 312. The lamp driver 310 receives a lamp on/off control signal from the computational control circuit 314 for use in discontinuing power being supplied to the lamp 330. The sense circuits 312 monitor the supply power input to the lamp 330 and provide feedback about the operation of the lamp 330 to the computational control circuit 314 and the ballast control circuit 308. The sense circuits 312 send a lamp current feedback signal and a lamp voltage feedback signal to the computational control circuit 314. The sense circuits 312 also send a lamp feedback signal to the ballast control circuit 308 to monitor other important lamp operational parameters.

The illumination control system 315 utilizes various factors and parameters to determine a rate of degradation for a particular type of lamp 330. The parameters and factors are used to control the output of the lamp 330 over its lifecycle. For example, illumination control system 315 may utilize operating hours (total hours the lamp has been operating) and lamp starts (total number of starting sequences for the lamp) to determine a rate of degradation of the lumen output of the lamp 330. Other parameters may be considered in determining the degradation rate. For example, a stabilized lamp operating voltage, lamp re-ignition voltage, voltage crest factors, current crest factors, or combination thereof may be used. Based upon the rate of degradation of the lamp 330, the illumination control system 315 adjusts the power supplied to the lamp 330 to provide a constant lumen output from the lamp 330.

The ballast operational software 318 resides in non-volatile storage 316 and provides a variety of timers 317. For example, the timers 317 include an accumulated lamp timer for measuring the number of operating hours for the lamp 330, and a lamp warm-up timer for determining when the lamp 330 has achieved a stable state after starting for use by the computational control circuit 314. The ballast operational software 318 also provides counters 319 for measuring the number of lamp starts for the lamp 330. The ballast operational software 318 also controls the operation of the ballast 302 and the power output by the ballast 302.

Figure 4:
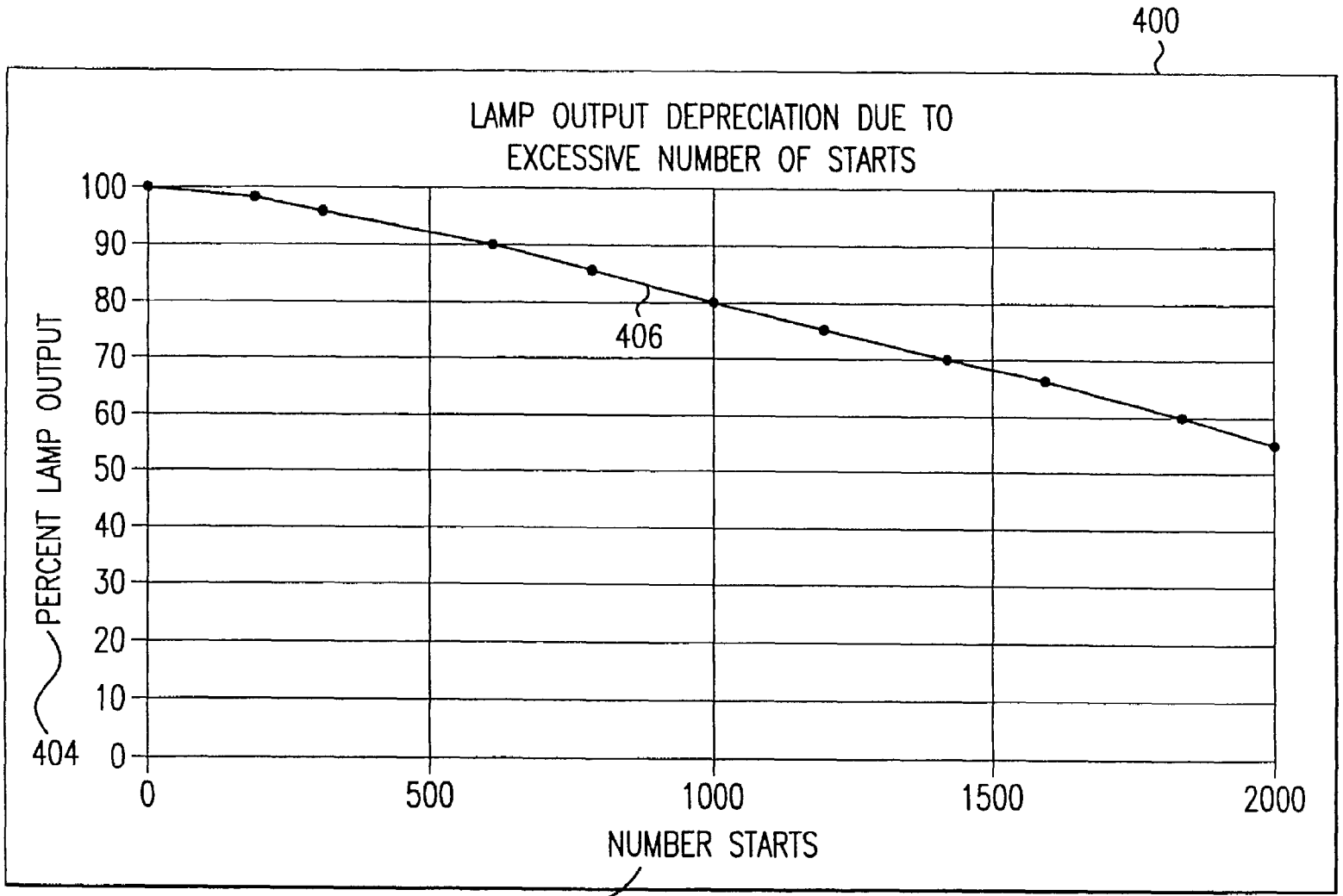
FIG. 4 is a chart illustrating lamp output degradation as a function of the number of lamps starts.

FIG. 4 illustrates a diagram 400, which compares the number of lamp starts to a percentage of lamp output power for the lamp 330. The X-axis 402 represents a number of lamp starts for the lamp 330 and the Y-axis 404 represents a percentage of output of the lamp 330. The output of the lamp 330, which is illustrated using curve 406, degrades due to lamp lumen depreciation as the number of starts for the lamp 330 increases.

In calculating degradation due to the number of hours that the lamp 330 is in operation, the computational control circuit 314 uses what is referred to as a burnloss equation to determine lamp degradation due to operating hours for use in calculating a dim level setting for the lamp 330. The following second order polynomial equation determines the value for burnloss $$\text{Burnloss}=A\times\text{Hours}^2+B\times\text{Hours}+C \qquad \text{Eq 1}$$

The burnloss equation is stored in the non-volatile storage device 316 along with constants A, B and C which are associated with the particular type of lamp 330 being powered by the ballast 302. The constants A, B & C are derived from a least squares curve fitting using experimental data, based on light loss due to the number of operating hours of the lamp 330. The process of deriving the constants A, B and C could also be done using a look-up table relating the variables, but such an approach would require additional storage space in non-volatile storage device 316.

In calculating degradation due to the number of lamp starts, the computational control circuit 314 uses what is referred to as a startloss equation to determine lamp degradation due to the number of lamp starts for use in calculating a dim level setting for the particular type of lamp 330. The following second order polynomial equation determines the value for startloss.

$$\text{Startloss}=D\times\text{Hours}^2+E\times\text{Hours}+F \qquad \text{Eq 2}$$

The startloss equation is stored in non-volatile storage device 316 along with constants D, E and F which are associated with a particular type of lamp 330 being powered by the ballast 302. The constants D, E and F are derived and stored in non-volatile storage device 316 in a similar manner as constants A, B and C.

The burnloss and startloss values for the lamp 330 are combined to calculate an overall expected level of light loss at a given point in the lifecycle of the lamp 330. A ratio is then calculated using the expected level of light loss at a given point in the lifecycle of the lamp 330 and a predetermined lumen output target is stored in non-volatile storage 316. For example, an expected lamp output for a given point (2000 hours) may be 95% of the initial lamp output, while the predetermined lumen output target is 85%. Thus, the output wattage to the lamp 330 is decreased by an appropriate amount to reduce the light output of the lamp 330 to the predetermined lumen output target. Although the target lumen output of the lamp 330 may be set to any reasonable lumen output, two meaningful output settings which may be used are an end of life lumen output and a mean lumen output. The mean lumen output is typically the average light output after 40% of the expected life of the lamp 330 has elapsed and is usually set by the manufacturer of the lamp 330.

By using the ratio of expected lumen output to current lumen output, the power supplied to the lamp 330 may be adjusted by the illumination control system 315 to set an appropriate source wattage for the lamp 330. For example, if the lamp 330 is a quartz metal halide HID lamp, a lumen output for the illumination control system 315 would be varied 1 8 times a change in wattage due to the relationship between the lamp wattage and the delivered light output for the particular type of lamp 330. Therefore, the wattage from the ballast 302 to the lamp 330 is changed by a ratio of 1/18 to obtain a desired constant lumen output. Thus, as the number of operating hours and lamp starts accumulate, the illumination control system 315 continually evaluates the degradation of the lamp 330 to compensate for lamp lumen degradation by increasing the wattage output supplied from the ballast 302 to the lamp 330. When the lamp 330 degrades to a point at which the lamp 330 requires more power than its maximum power rating (100%) to maintain the desired lumen output level, the illumination control circuit 315 will limit the power output by the ballast 302 to the maximum power rating of the lamp 330. By limiting the lamp 330 to its maximum power rating, safety is improved because the lamp 330 is not overdriven which could damage the circuitry within the ballast 302 and the lamp 330. Once the lifecycle of the lamp 330 is completed, the lamp 330 is subsequently replaced.

After the lamp 330 is replaced, values such as the number of operating hours and the number of lamp starts stored in the non-volatile storage device 316 are reset. Although it is possible to reset the non-volatile storage device 316 manually, a reset means using a form of lamp replacement detection may be employed. The lamp replacement detection technique may be employed using software included in ballast operational software 318 which is stored in the non-volatile storage device 316 for use by the computational control circuit 314. By comparing the measured lamp voltage of the lamp 330 to the lamp voltage stored in memory, the computational control circuit 314 determines if a change in lamp voltage has occurred which would indicate that the lamp 330 has been replaced.

Thus, a lamp replacement detection technique may utilize the fact that as a lamp ages, many electrical variables associated with the lamp change. For example, a root mean squared (RMS) voltage across the lamp 330 and a re-ignition voltage for the lamp 330 change over time. The lamp replacement detection technique uses the software included in ballast operational software 318 to store these voltages and other variables in the non-volatile storage device 316. Each time the lamp 330 is started, a stabilized lamp voltage is compared to a stored stabilized lamp voltage setting. If a step in voltage is greater than a predetermined threshold level stored in the non-volatile storage device 316, then it is determined that the lamp 330 has been replaced. For example, if a decrease of 5 volts in lamp voltage is determined by the computational control circuit 314 after the lamp voltage has stabilized, the lamp 330 is determined to have been replaced. After such a determination, the number of operating hours and the number of lamps starts are reset in the non-volatile storage device 316.

Figure 5:
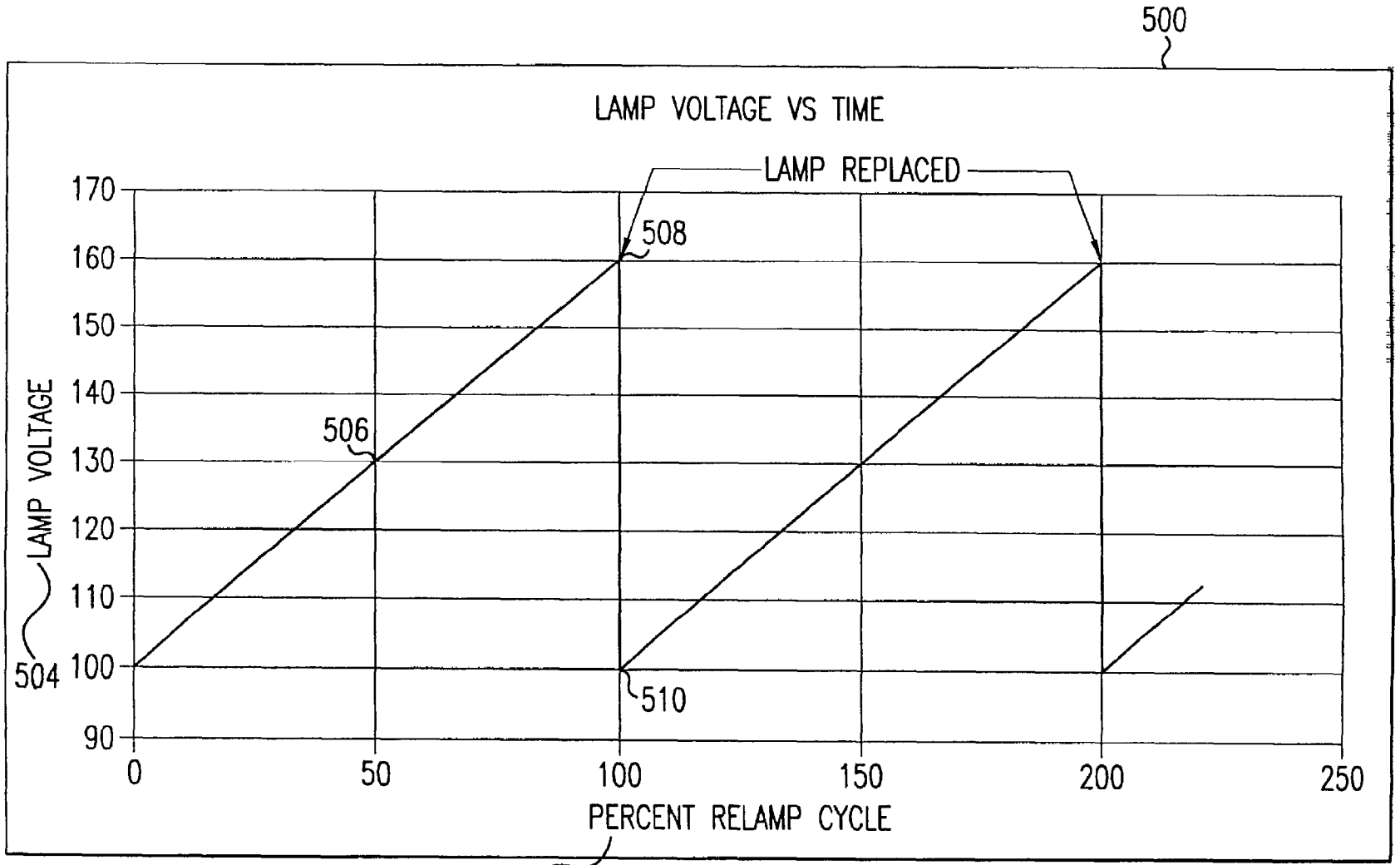
FIG. 5 is a chart illustrating a re-lamp cycle for an HID lamp for lamp replacement detection.

FIG. 5 illustrates the above described replacement technique using the comparison of lamp start voltages. The chart 500 graphs a percent relamp cycle 502 versus a lamp start voltage 504 using curve 506. During each start, the voltage of the lamp 330 is obtained and compared to a lamp voltage stored in the non-volatile storage device 316 from the previous lamp start. If the lamp voltage step between starts is greater than the predetermined threshold, for example, a step from 160 volts (508) to 100 volts (510), the illumination control system 315 determines that the lamp 330 has been replaced since the stabilized lamp voltage is reduced by 60 volts from a previous lamp operation. Subsequently, the number of operating hours and the number of lamp starts stored in the non-volatile storage device 316 are reset. Those skilled in the art will recognize there are many other comparable means to perform the lamp replacement detection described above.

Figure 6:
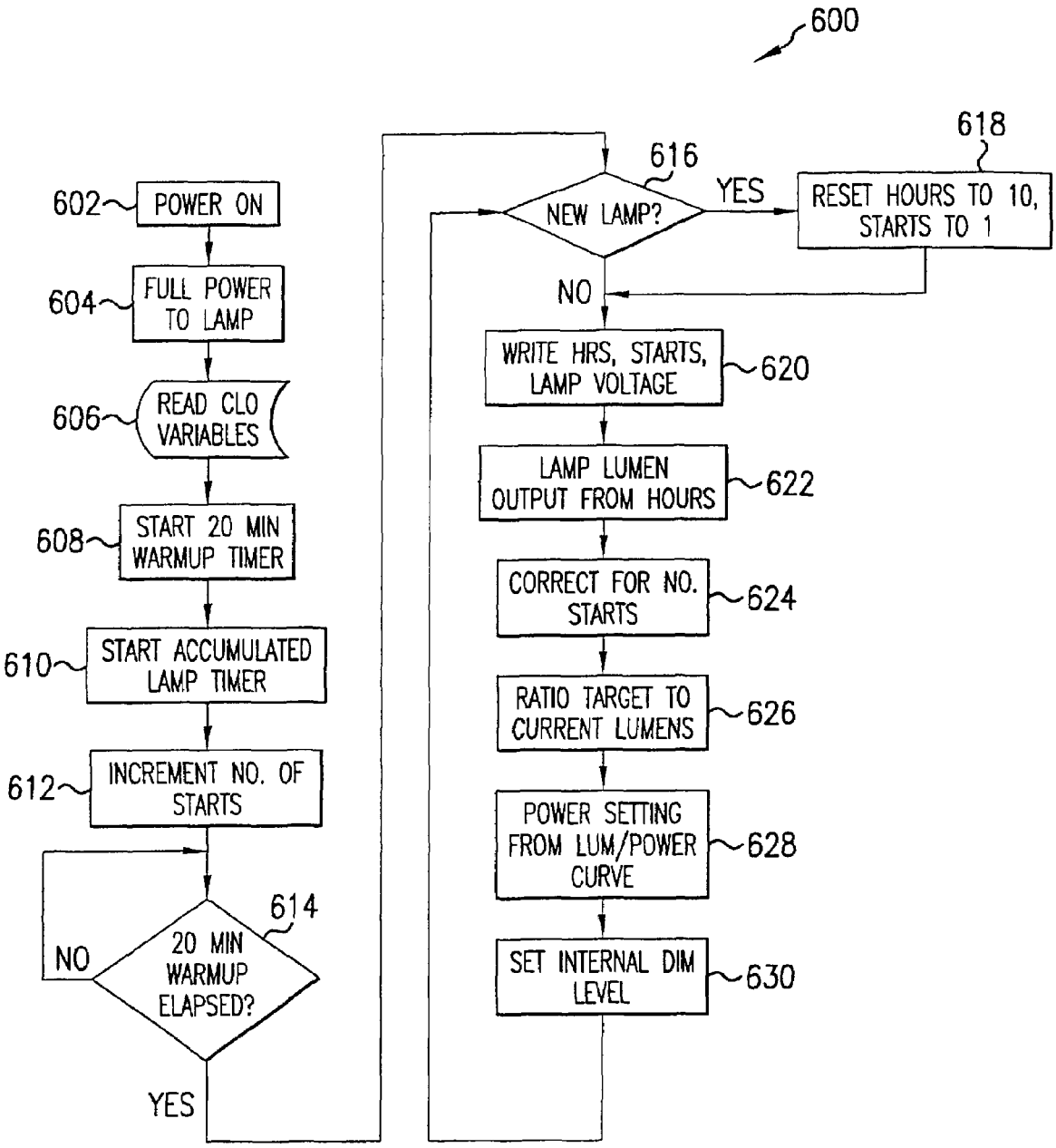
FIG. 6 is a flow chart illustrating the process steps of an embodiment of the control circuitry of the invention.

FIG. 6 is flow diagram 600 of process steps implemented by the illumination control system 315. The blocks in the flow diagram 600 may be performed in the order shown, out of the order shown, or may be performed in parallel. At step 602, power is applied to the ballast 302 turning on the lamp 330. Next, at step 604, the lamp 330 is adjusted to full power At step 606, ballast 302 obtains a variety of constant lumen output control (CLO) values, for example, total lamp starts, historic lamp voltage and lamp life constants based on the particular type of lamp 330 used from the non-volatile storage device 316. At step 608, the ballast 302 starts a lamp warm-up timer having a predetermined warm-up time setting, for example, 20 minutes. At step 610, the accumulated lamp timer is started. The lamp warm-up timer and accumulated lamp timer are created using the timers 317 which are stored in the non-volatile storage device 316 for use by the computational control circuit 314. Next, at step 612, the ballast 302 increments the counter 319 (FIG. 3) measuring the number of lamp starts and stores the new lamp start value in the non-volatile storage device 316. At step 614, the ballast 302 determines whether the predetermined warm-up time period has elapsed to assure the lamp wattage and voltage has stabilized. If the warm-up time period has not elapsed, the process returns to step 614 At step 616, if the warm-up time period has elapsed, the ballast 302 determines whether the lamp 330 has been replaced using the technique described in FIG. 5.

If the lamp 330 has been replaced, then, at step 618, the ballast 302 resets the number of operating hours and the number of lamp starts to their predetermined reset values. For example, operating hours are assigned a value of 10 and the number of starts is assigned a value of 1. If the lamp 330 has not been replaced, the process proceeds to step 620 where the ballast 302 writes the current value for the number of operating hours, the number of lamp starts and a lamp start voltage being used by the lamp 330 into the non-volatile storage device 316.

At step 622, the ballast 302 determines the projected lamp lumen output for the lamp 330 based on the degradation curve stored in the non-volatile storage device 316 for the particular lamp type. Subsequently, at step 624, the degradation of the lamp due to the number of starts is derived from the stored compensation curve for the particular type of lamp 330 being utilized At step 626, the target output lumens of the lamp 330 is ratioed to the calculated current lumens to adjust the power supplied to the lamp 330 to maintain a constant lumen output from the lamp 330 At step 628, the ballast 302 determines the actual power setting, in watts, to which the lamp 330 should be adjusted to provide the target lumens by converting output lumens to watts. The conversion is calculated from a light output versus power curve for the lamp type 330 being utilized. At step 630, the ballast 302 adjusts the output wattage to the lamp 330 by setting an internal reduced power level setting.

Thus, by using the ballast 302 which can adjust power input to the lamp 330, an illumination system may be implemented which is efficient and cost-effective.

As mentioned above, the ballast 302 may also utilize the stabilized lamp operating voltage to maintain a constant lumen output for the lamp 330. Instead of combining the results of the burnloss and startloss equations, the computational control circuit 314 calculates a value for what is referred to as Slov, and combines the Slov and startloss equations to maintain a constant lumen output for the lamp 330.

Slov represents the stabilized lamp operating voltage and could be determined by using the following second order polynomial equation $$Slov=G\times Hours^2+H\times Hours+I$$

The value for Slov is stored in non-volatile storage device 316 along with constants G, H and I which are associated with a particular type of lamp 330 being powered by the ballast 302. The constants G, H and I are derived and stored in non-volatile storage device 316 in a similar manner as constants A, B and C.

Figure 7:
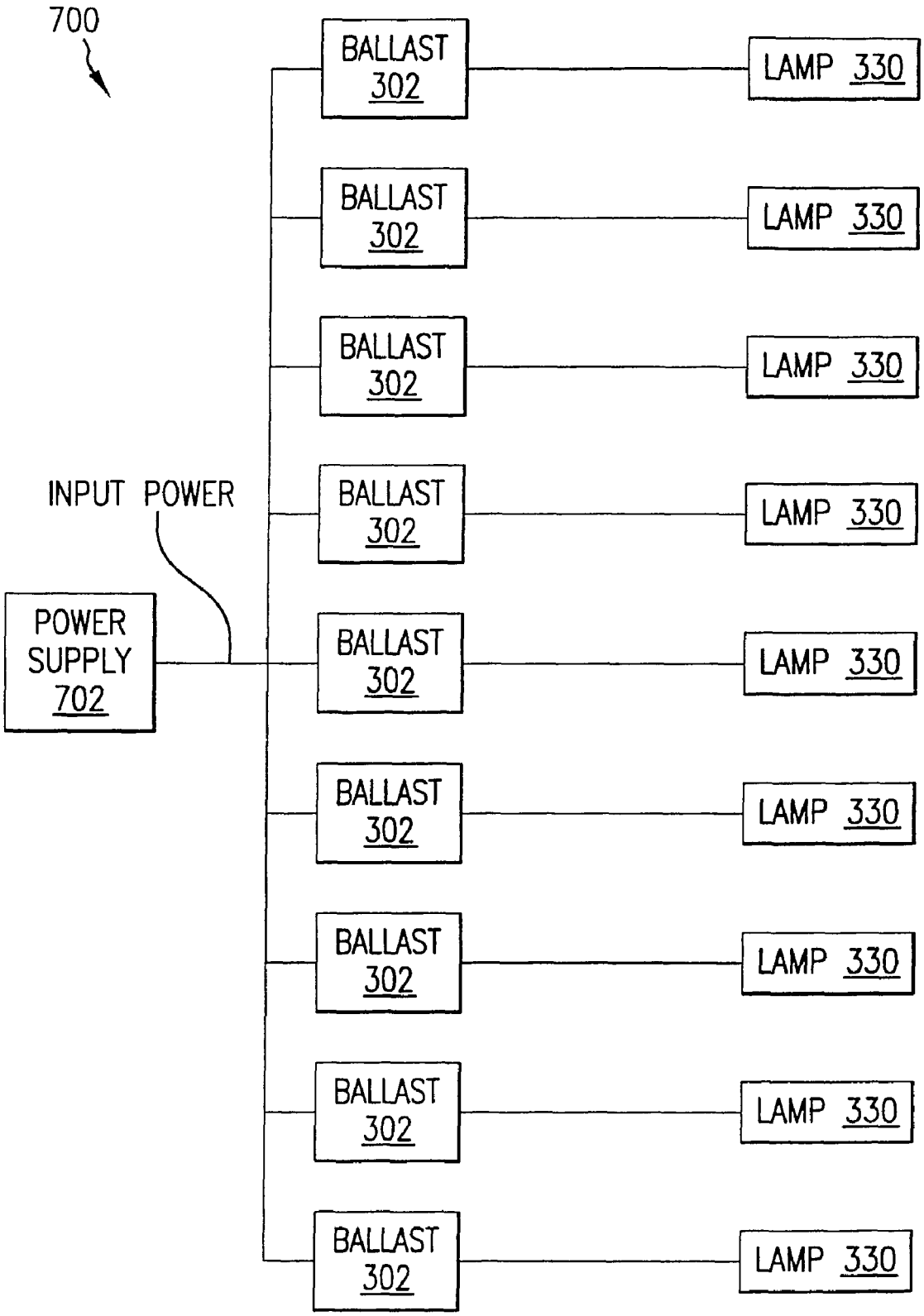
FIG. 7 is a block diagram of an illumination system for implementing a first exemplary embodiment of the present invention.

FIG. 7 illustrates an illumination system 700 using multiple ballasts 302. Illumination system 700 includes multiple ballasts 302 each connected to power supply 702 for controlling the lumen output of a lamp 330 connected to each ballast 302. Thus, illumination system 700 utilizes multiple ballasts 302 and lamps 330 to illuminate larger areas which could be used in a variety of lighting applications.

Figure 8:
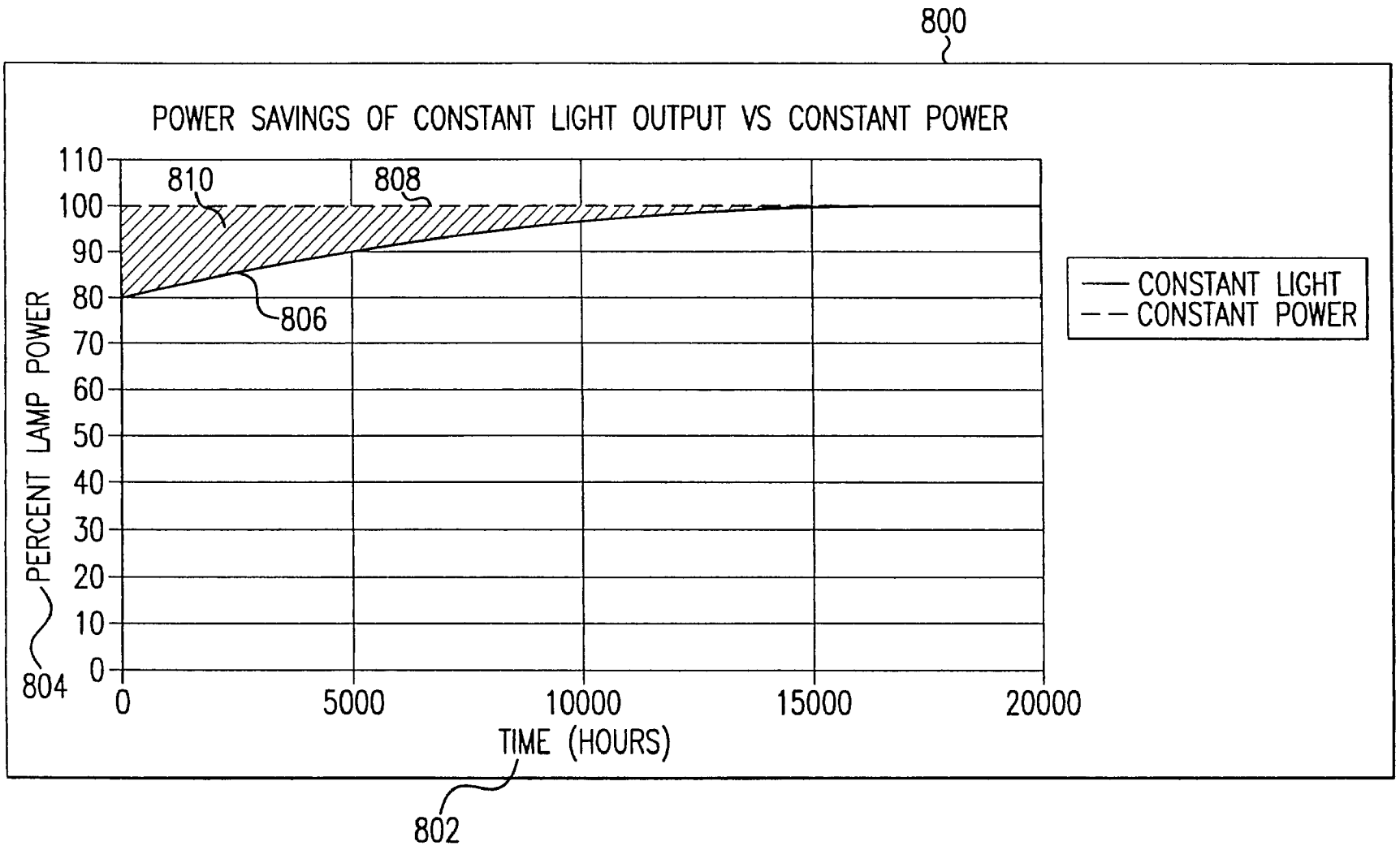
FIG. 8 is a chart illustrating power consumption of a conventional ballast and a ballast according to an embodiment of the invention.

FIG. 8 is a diagram 800 illustrating power consumption of a lamp 330 using a conventional ballast and the ballast 302. In FIG. 8, a time component (X-axis 802) and a percent lamp power component (Y-axis 804) are used to compare a constant light output 806 produced by the lamp 330 using supply power from the ballast 302 versus light output 808 from the lamp 330 using supply power from a conventional ballast. Because a conventional ballast cannot adjust power input to the lamp 330, the conventional ballast provides full power to the lamp 330 when full power is not needed. The area indicated at 810 between curves 806 and 808 illustrates power wasted when a lamp 330 is conventionally controlled. Thus, power consumed by a lamp 330 that is controlled by a conventional ballast exceeds the power consumed by a lamp 330 that is controlled by the ballast 302. By adjusting the power output from the ballast 302, the lamp 330 is provided with only enough power to maintain an established lumen output level. Thus, power costs are reduced since the ballast 302 does not overdrive the lamp 330 by supplying more power than is required.

Figure 9A:
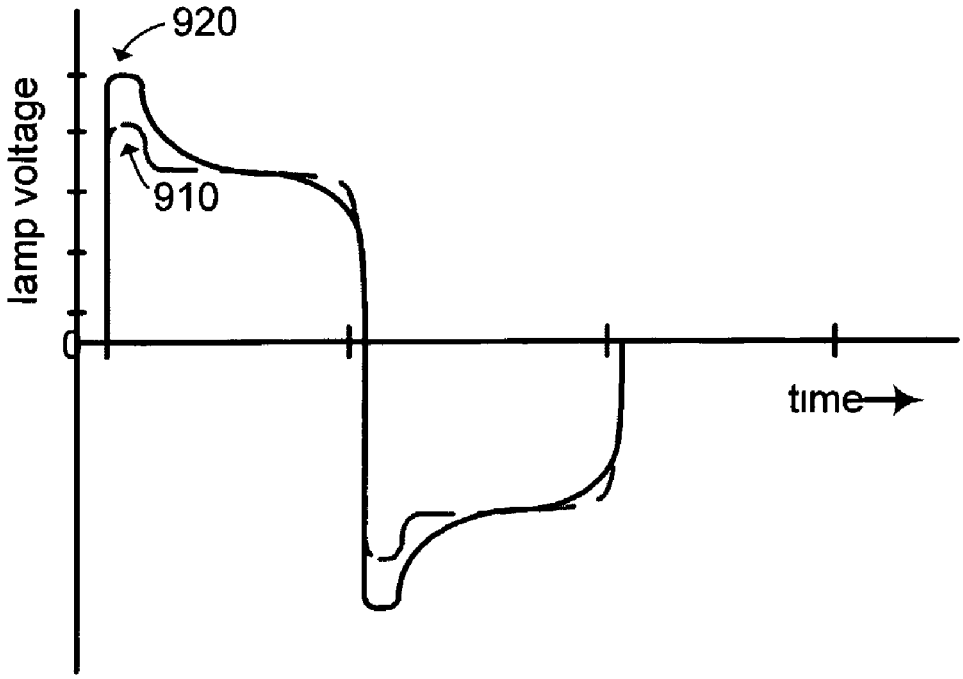
FIG. 9A is a chart illustrating a re-ignition peak voltage as the lamp voltage vanes with time.

As mentioned with reference to FIG. 3, another alternative to burning hours and lamp starts utilizes the re-ignition voltage, or more specifically the voltage crest factor (VCF). The re-ignition of the lamp discharge occurs each time the lamp current changes polarity. As a result, the arc and electron flow must be re-established, which takes a finite amount of time. This time creates a resultant arc impedance change, which results in an instantaneous rise in lamp voltage that is limited by the instantaneous open circuit voltage of the ballast. The time and voltage necessary to re-establish the arc is dependent on the ability of the electrode to supply electrons and continue the recombination process. As the HID lamp 330 ages, the ability of the electrode and fill gas to provide and transport electrons decreases. The resultant magnitude of the voltage peak, measured at zero current crossing, is called the re-ignition voltage, which subsequently increases. Turning now to FIG. 9A, the peak re-ignition voltage for a new HID lamp is shown at reference numeral 910. After some time, the peak re-ignition voltage for this aged HID lamp is shown at reference numeral 920. Hence the peak re-ignition voltage is a factor that vanes with lamp age.

Figure 9B:
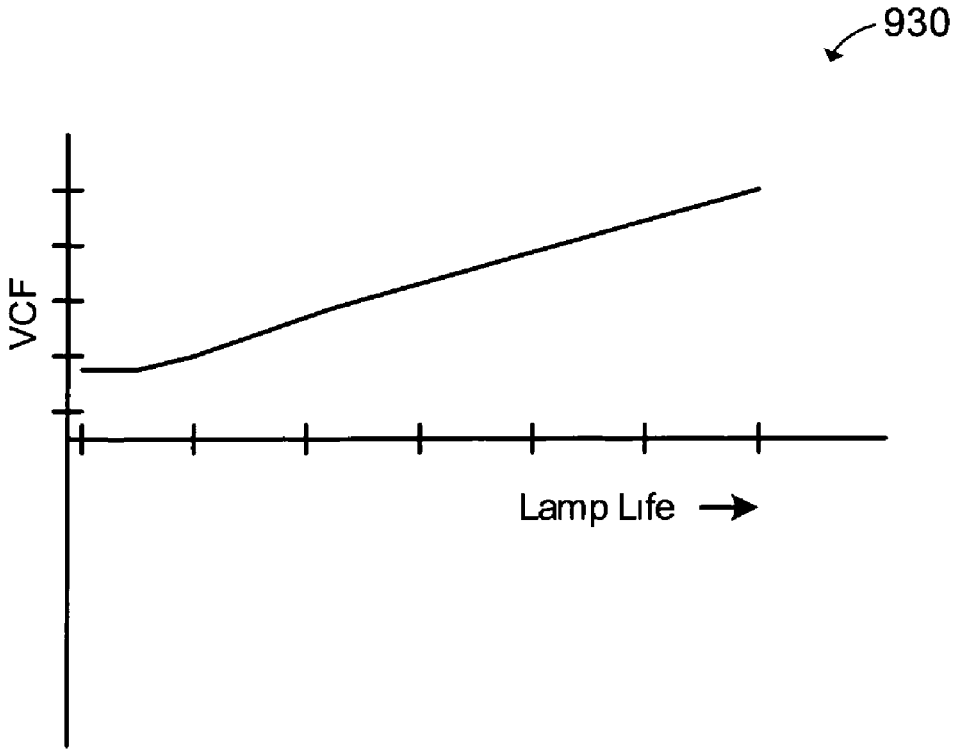
FIG. 9B is a chart illustrating the relationship between a voltage crest factor and lamp life.

The VCF is defined using the peak re-ignition and rms lamp operating voltage that can be used for monitoring lamp life. More specifically, the VCF is the ratio of the peak re-ignition voltage to the rms voltage of the lamp operating voltage. Because the VCF changes as the peak re-ignition voltage changes with lamp age, the VCF vanes with lamp age. The graph 930 in FIG. 9B illustrates the variation of the VCF with lamp life. Thus, monitoring of the VCF can be used as a parameter to estimate the burning hours of the lamp 330 and provide data to the computational control 314 to adjust the power to the lamp 330 for maintaining constant lumen output.

While the invention has been described in detail in connection with an exemplary embodiment, it should be understood that the invention is not limited to the above-disclosed embodiment. Rather, the invention can be modified to incorporate any number of variations, alternations, substitutions, or equivalent arrangements not heretofore described, but which are commensurate with the spent and scope of the invention. In particular, the specific embodiments of the constant lumen output control system described should be taken as exemplary and not limiting. For example, the ballast 302 may also determine lumen degradation of lamp 330 by measuring the change in the RMS voltage, voltage and current crest factors, re-ignition voltage or combination of these parameters of lamp 330 or by monitoring the lumens emanating from the lamp 330, by lumens received at a task being illuminated by the lamp 330. Accordingly, the invention is not limited by the foregoing description or drawings, but is only limited by the scope of the appended claims.

We claim:

1. A method of providing constant lumen output control to a lumen output device, comprising:

determining a number of operating hours for a lamp, determining a number of lamp starts for the lamp, creating a degradation value by combining the number of operating hours and the number of lamp starts, forming an output ratio for outputting power to the lamp using the degradation value and a target lamp output, and setting a reduced power level for the lamp using the output ratio.

2. The method of claim 1, wherein the target lamp output is specific to the particular type of lamp.

3. The method of claim 1, wherein the reduced power level is adjusted throughout the life of the lamp to maintain a constant lumen output.

4. The method of claim 3, wherein the adjustment compensates for lamp degradation within the lamp.

5. The method of claim 1, further comprising resetting the number of operating hours and the number of lamp starts when the lamp is replaced.

6. The method of claim 5, wherein a lamp voltage comparison is used to determine when the lamp has been replaced.

7. The method of claim 1, wherein the step of determining the number of operating hours, the step of determining the number of lamp starts, the step of creating a degradation value, the step of forming an output ratio and the step of setting a reduced power level are performed by a processor.

8. A lumen output control circuit, comprising:

a timer for measuring a number of operating hours for a lamp, a counter for measuring a number of lamp starts for the lamp, a non-volatile storage device having computer-executable instructions, wherein the non-volatile storage device is configured to store the number of operating hours and the number of lamp starts;

a processor functionally coupled to the non-volatile storage device and configured, by the computer-executable instructions, to create a degradation value by combining the number of operating hours and the number of lamp starts, and to form an output ratio for outputting power to the lamp using the degradation value and a target lamp output.

9. The circuit of claim 8, wherein the processor is configured to set a reduced power level for the lamp using the output ratio.

10. The circuit of claim 9, wherein the reduced power level is adjusted throughout the life of the lamp to maintain a constant lumen output.

11. The circuit of claim 8, wherein the target lamp output is specific to the particular type of lamp.

12. The circuit of claim 8, wherein the non-volatile storage device stores a lamp voltage for each lamp start for the lamp, and wherein a lamp voltage comparison is used to determine when the lamp has been replaced.

* * * * *